US008753076B2

(12) United States Patent
Yen et al.

(10) Patent No.: US 8,753,076 B2
(45) Date of Patent: Jun. 17, 2014

(54) CENTRIFUGAL FAN

(75) Inventors: Kevin Yen, Nagano (JP); Hiromitsu Kuribayashi, Nagano (JP)

(73) Assignee: Sanyo Denki Co., Ltd., Tokyo (JP)

( * ) Notice: Subject to any disclaimer, the term of this patent is extended or adjusted under 35 U.S.C. 154(b) by 962 days.

(21) Appl. No.: 12/813,902

(22) Filed: Jun. 11, 2010

(65) Prior Publication Data

US 2010/0316511 A1 Dec. 16, 2010

(30) Foreign Application Priority Data

Jun. 12, 2009 (JP) ..... 2009-141612

(51) Int. Cl.
*F04D 29/44* (2006.01)

(52) U.S. Cl.
USPC ..... 415/204

(58) Field of Classification Search
USPC ..... 415/121.1, 182–185, 194, 204–206, 415/208.1, 208.2, 211.1, 911; 416/DIG. 2; 417/423.1, 424.1
See application file for complete search history.

(56) References Cited

U.S. PATENT DOCUMENTS

| | | | | |
|---|---|---|---|---|
| 7,244,099 | B2 | 7/2007 | Yamasaki | |
| 7,281,898 | B2 * | 10/2007 | Baek et al. | 416/186 R |
| 2004/0131465 | A1 | 7/2004 | Ochiai et al. | |
| 2006/0039783 | A1 | 2/2006 | Horng et al. | |

FOREIGN PATENT DOCUMENTS

| | | |
|---|---|---|
| JP | 61-145899 U | 9/1986 |
| JP | 05-332293 | 12/1993 |
| JP | 06-129396 | 5/1994 |
| JP | 07-279892 | 10/1995 |
| JP | 2001-140790 | 5/2001 |
| JP | 3105067 U | 10/2004 |
| JP | 2006-077631 | 3/2006 |

OTHER PUBLICATIONS

Machine Translation of JP05332293A, Feb. 26, 2014.*
Japanese Office Action and English Translation of JP 2009-141587, mailed Mar. 5, 2013, 6 pages.
Japanese Office Action and English Translation of JP 2009-14162, mailed Mar. 5, 2013, 7 pages.
Chinese Office Action with English translation excerpts dated Aug. 5, 2013, 9 pages.

* cited by examiner

*Primary Examiner* — Nathaniel Wiehe
*Assistant Examiner* — Adam W Brown
(74) *Attorney, Agent, or Firm* — Rankin, Hill & Clark LLP

(57) ABSTRACT

A centrifugal fan is provided, in which the value of static pressure with respect to the flow rate, namely, the flow rate-static pressure characteristic may be set to a relatively arbitrary value without increasing noise. An impeller of the centrifugal fan comprises an impeller body, a plurality of stems, a blade mounting member, a plurality of main blades, and a plurality of sub blades. The main blades are shaped to suck air into a casing through a suction port when the impeller rotates in a direction of normal rotation. The sub blades are shaped to suck air into the casing through the suction port when the impeller rotates in a direction of reverse rotation opposite to the direction of normal direction.

4 Claims, 6 Drawing Sheets

CENTRIFUGAL FAN

TECHNICAL FIELD

The present invention relates to a centrifugal fan.

BACKGROUND ART

Japanese Patent Application Publication No. 2006-77631 (JP2006-77631A) discloses a centrifugal fan referred to as a sirocco fan. The fan comprises an impeller and a casing. The impeller comprises a plurality of blades. The impeller is fixed to the rotary shaft of an electric motor to rotate therewith. The casing includes a suction port and a discharge port. The suction port opens in an axial direction of the rotary shaft, and the discharge port opens in a direction tangent to a direction of rotation of the impeller. The casing includes a first wall portion in which the suction port is formed, a second wall portion facing the first wall portion, and a third wall portion including the discharge port. The third wall portion couples the first and second wall portions. The impeller includes an impeller body and a blade support body. The impeller body has a cylindrical circumferential wall which rotates about the rotary shaft. The blade support body is fixed to an end of the impeller body to support the blades and extends in a radial direction. The blade support body is shaped like a circular plate having an opening in its center. The periphery of the opening of the blade support body is fixed to the circumferential wall of the impeller body. The blades are fixed to a radially outside end portion of the blade support body. The blades extend from the radially outside end portion of the blade support body toward the first wall portion of the casing. End portions of the blades on the side of the first wall portion are fixed to an annular blade mounting member which is disposed concentrically with the circumferential wall of the impeller body.

A centrifugal fan disclosed in Japanese Patent Application Publication No. 2004-353665 (JP2004-353665A) includes an annular blade mounting member which is located closer to a suction port side than a blade support body and to which a plurality of blades are fixed. The blades extend beyond the annular blade mounting member toward a first wall portion in which a suction port of a casing is formed. End portions of the blades on aside of the suction port are located in the vicinity of the suction port of the casing.

SUMMARY OF INVENTION

There is a demand for a centrifugal fan in which a static pressure value with respect to an airflow rate (air flow-static pressure characteristic) may be arbitrarily set to a certain extent without increasing noise.

An object of the present invention is to provide a centrifugal fan in which a static pressure value with respect to an airflow rate (air flow-static pressure characteristic) may be arbitrarily set to a certain extent without increasing noise.

A centrifugal fan, improvements of which are aimed at by the present invention, comprises: an electric motor including a rotary shaft; a casing including a suction port opening in an axial direction of the rotary shaft; and an impeller fixed to the rotary shaft of the electric motor to rotate therewith. The impeller of the present invention includes; a plurality of blades; an impeller body; a plurality of stems; and an annular blade mounting member. The blades of the impeller include a plurality of main blades and a plurality of sub blades. The impeller body rotates about the rotary shaft. The stems are arranged at intervals in a direction of rotation of the rotary shaft, with one end of each stem fixed to a portion of the impeller body in the vicinity of the suction port. The annular blade mounting member is arranged concentrically with the impeller body, with the other end of each stem fixed thereto. The main blades are arranged at intervals in the direction of rotation of the rotary shaft with one end of each main blade fixed to the blade mounting member. The main blades extend along the axial line of the rotary shaft in a direction away from the suction port. The main blades are shaped to suck air into the casing through the suction port when the impeller rotates in a direction of normal rotation. The sub blades are arranged at intervals in the direction of rotation of the rotary shaft with one end of each sub blade fixed to the blade mounting member. The sub blades extend along the axial line toward the suction port. The sub blades are shaped to suck air into the casing through the suction port when the impeller rotates in a direction of reverse rotation opposite to the direction of normal rotation.

In the configuration of the present invention, the blades are arranged with the one end of each blade fixed to the blade mounting member located on the side of the suction port. Accordingly, no member for mounting the blades is present at a location facing the suction port of the casing in the axial direction. For that reason, a part of air sucked into the casing through the suction port is directed in a radial direction of the impeller body and is then discharged after having hit against an inner wall of the casing facing the suction port.

More specifically, a centrifugal fan of the present invention may comprise: an electric motor including a rotary shaft; a casing including a suction port opening in an axial direction of the rotary shaft and a discharge port for discharging the air sucked through the suction port; and an impeller fixed to the rotary shaft of the electric motor to rotate therewith. The impeller includes a plurality of blades, an impeller body, a plurality of stems, and an annular blade mounting member. The blades include a plurality of main blades and a plurality of sub blades. The impeller body includes a cylindrical peripheral wall that extends along the axial line of the rotary shaft and rotates around the rotary shaft. The plurality of stems are arranged at intervals in a direction of rotation of the rotary shaft with one end of each stem fixed to a portion of the impeller body in the vicinity of the suction port. An annular blade mounting member is arranged concentrically with the impeller body with the other end of each stem fixed thereto. The plurality of main blades are arranged at intervals in the direction of rotation of the rotary shaft with one end of each main blade fixed to the blade mounting member. The main blades extend along an axial line of the rotary shaft in a direction away from the suction port. The main blades are shaped to suck air into the casing through the suction port in the axial direction when the impeller rotates in a direction of normal rotation. The plurality of sub blades are arranged at intervals in the direction of rotation of the rotary shaft with one end of each sub blade fixed to the blade mounting member. The sub blades extend along the axial line toward the suction port. The sub blades are shaped to suck air into the casing through the suction port in the axial direction when the impeller rotates in a direction of reverse rotation opposite to the direction of normal rotation.

If the main blades are mounted on the annular blade mounting member supported by the stems as in the present invention, a flow of air from the suction port to the discharge port is smoothed, thereby reducing noise. In addition, resistance of the air during rotation of the impeller may be reduced and accordingly power consumption may be reduced. Further, in the present invention, the sub blades which suck air into the casing through the suction port in the axial direction when the impeller rotates in the direction of reverse rotation opposite to the direction of normal rotation are fixed to the blade mounting member so that the sub blades extend along the axial line toward the suction port. For this reason, a direction in which the main blades send out air in the direction of rotation (circumferential direction of the rotary shaft) and a direction in which the sub blades send out air are reversed. Back flow of the air sent out from the main blades into the suction port may be thereby prevented. For that reason, this arrangement contributes to reduction of noise. By arbitrarily setting the number of the sub blades, a static pressure may be arbitrarily set within a relatively wide variation range.

Preferably, the number of the sub blades may be equal to or less than half the number of the main blades, and may be equal to or more than one fourth of the number of the main blades. With this arrangement, the static pressure with respect to an airflow rate may be increased more than ever without increasing noise.

The casing may be constituted from a first wall portion with the suction port formed therein; a second wall portion facing the first wall portion with the impeller interposed therebetween; and a third wall portion which couples the first wall portion and the second wall portion. The other end of each stem may be terminated beyond an opening edge portion of the suction port. The annular blade mounting member may be located radially outward of the opening edge portion and may include a first side surface facing the first wall portion and a second side surface facing the first side surface in the axial direction. The first side surface of the annular blade mounting member may be curved to be convex toward the second wall portion and may be shaped so that a distance between the first side surface and the first wall portion increases radially outward. In this case, the one end of each sub blade is fixed to the first side surface, and the one end of each main blade is fixed to the second side surface. With this arrangement, air may be smoothly guided between the blades along the second side surface of the annular blade mounting member.

Preferably, a gap formed between end surfaces of the sub blades facing the first wall portion and the first wall portion may be constant in size. With this arrangement, backflow of air into the suction port may be effectively prevented.

Further, at least one of the main blades may each include: a first side portion extending along the second side surface of the annular blade mounting member; a second side portion facing the third wall portion of the casing and extending in the axial direction from the one end of the main blade fixed to the blade mounting member; a third side portion located radially more inward than the second side portion; and a fourth side portion facing the second wall portion of the casing. In this case, preferably, the third side portion includes a first half portion continuous with the first side portion, and a second half portion continuous with the first half portion and the fourth side portion, the first half portion being inclined so that a distance between the first half portion and the second side portion increases toward the second half portion, the second half portion extending in parallel with the second side portion. With this arrangement, a space may be ensured between the inclined first half portion and the suction port. Thus, when an orientation of air sucked through the suction port in the axial direction is changed in the radial direction, the orientation may be changed smoothly.

Preferably, defining a maximum length of each main blade in the axial direction as L1 and a maximum length of each sub blade in the axial direction as L2, L1 and L2 may be determined so that a relationship of $\frac{1}{5}<L2/L1<\frac{1}{2}$ holds. When L2/L1 is equal to or more than ½, fluid efficiency of the main blades is reduced. When L2/L1 is equal to or less than ⅕, backflow of air into the suction port cannot be prevented.

The present invention may also be implemented as an impeller for a centrifugal fan. The impeller for a centrifugal fan of the present invention comprises: an impeller body which rotates about a rotary shaft; a plurality of stems arranged at intervals in a direction of rotation of the rotary shaft, with one end of each stem fixed to the impeller body; an annular blade mounting member arranged concentrically with the impeller body, with the other end of each stem fixed thereto; a plurality of main blades arranged at intervals in the direction of rotation of the rotary shaft with one end of each main blade fixed to the blade mounting member; and a plurality of sub blades arranged at intervals in the direction of rotation of the rotary shaft with one end of each sub blade fixed to the blade mounting member. The main blades extend along an axial line of the rotary shaft and are shaped to suck air along the axial line when the impeller rotates in a direction of normal direction. The sub blades extend along the axial line in a direction away from the main blades and are shaped to suck air along the axial line when the impeller rotates in a direction of reverse rotation opposite to the direction of normal rotation.

BRIEF DESCRIPTION OF DRAWINGS

These and other objects and many of the attendant advantages of the present invention will be readily appreciated as the same becomes better understood by reference to the following detailed description when considered in connection with the accompanying drawings.

DESCRIPTION OF EMBODIMENTS

Figure 1:
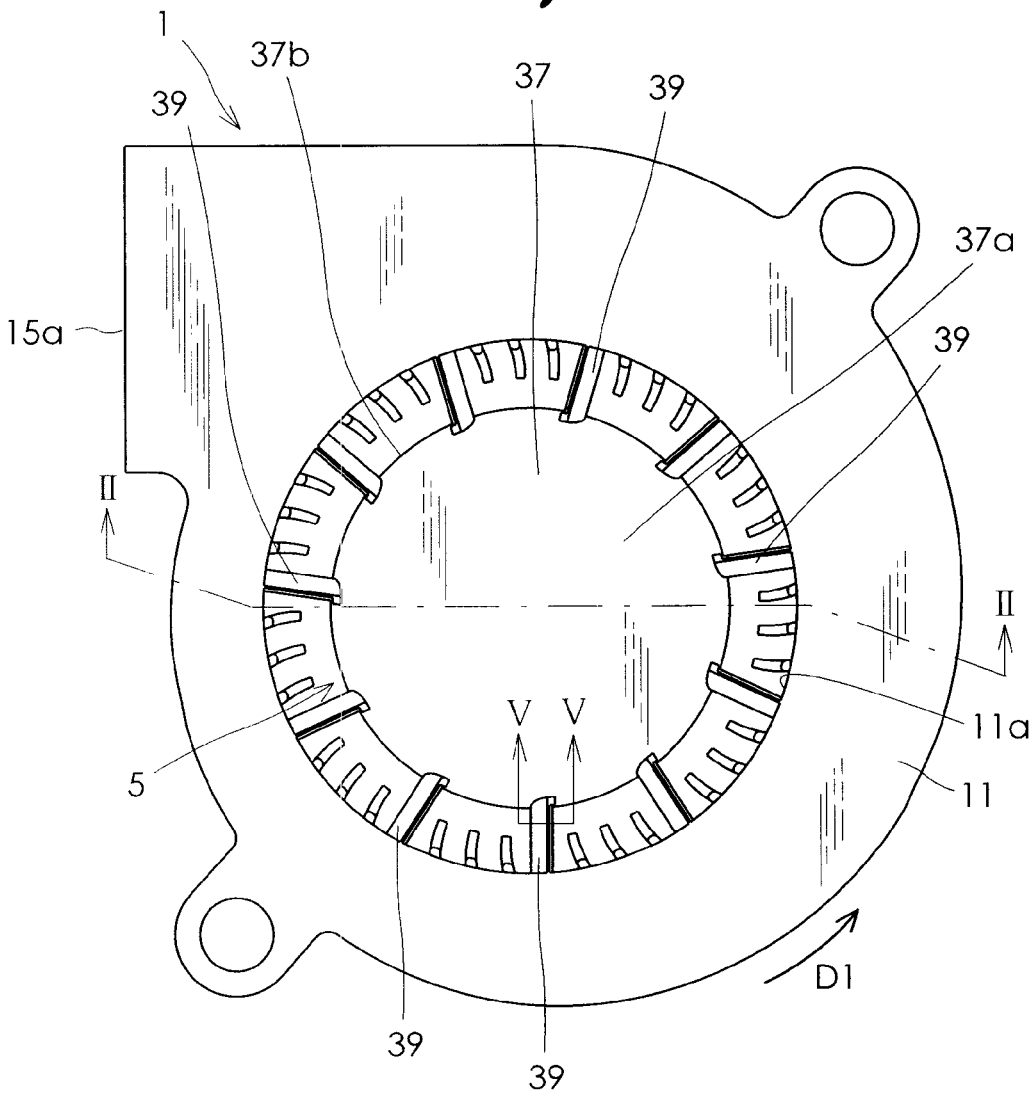
FIG. 1 is a plan view of a centrifugal fan according to an embodiment of the present invention.
Figure 2:
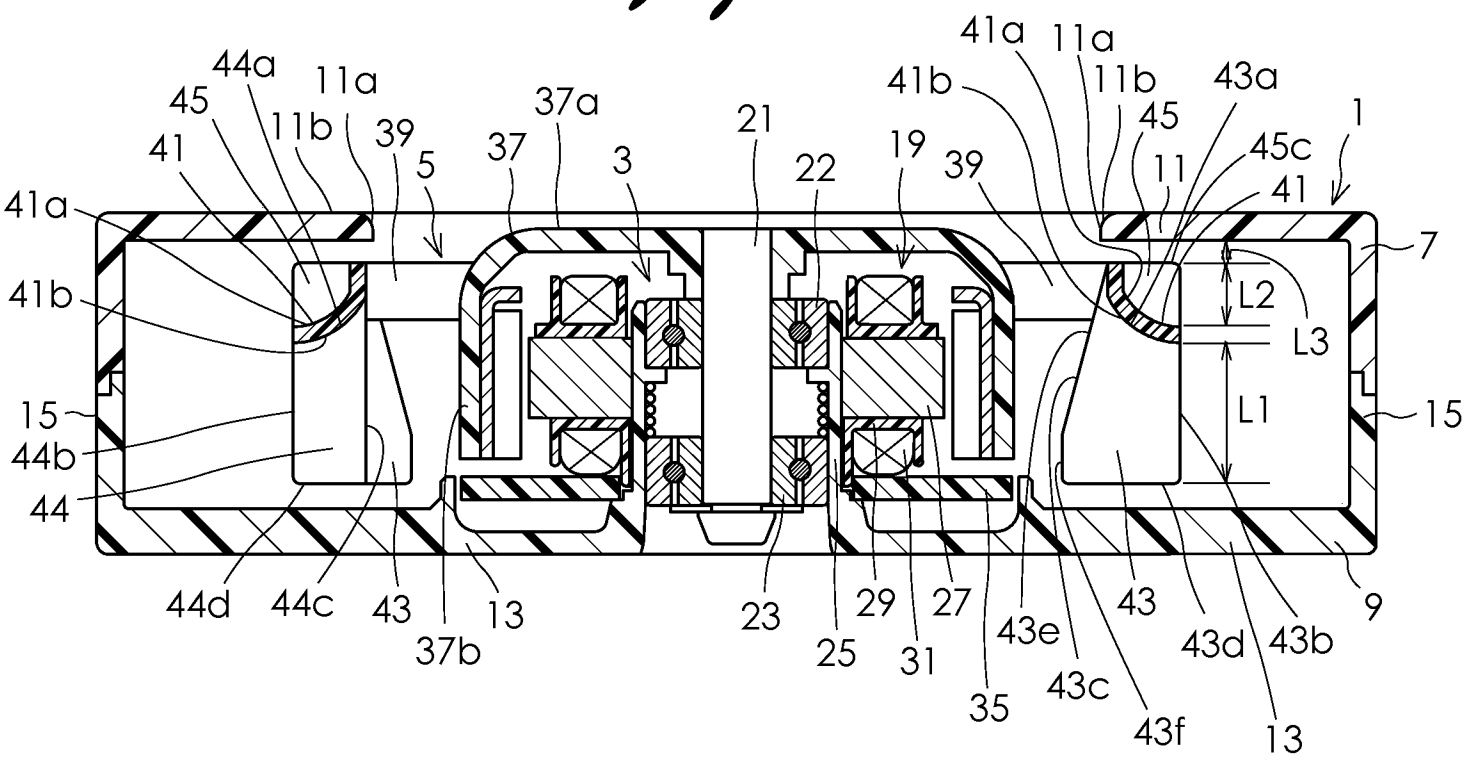
FIG. 2 is a sectional view taken along a line II-II of FIG. 1.

Embodiments of the present invention will be described below in detail with reference to drawings. FIG. 1 is a plan view of a centrifugal fan according to an embodiment of the present invention. FIG. 2 is a sectional view taken along a line II-II of FIG. 1. The centrifugal fan (sirocco fan) according to this embodiment comprises a casing 1, an electric motor 3, and an impeller 5. The electric motor 3 and the impeller 5 are disposed in the casing 1. The casing 1 is formed by combining a first casing half portion 7 and a second casing half portion 9, as shown in FIG. 2. When the first casing half portion 7 is combined with the second casing half portion 9, the casing 1 is constituted from a first wall portion 11, a second wall portion 13 facing the first wall portion with the impeller interposed therebetween, and a third wall portion 15 coupling the first wall portion 11 and the second wall portion 13. A circular suction port 11*a* is formed in the center of the first wall portion 11. The circular suction port 11*a* sucks air from an outside. A discharge port 15*a* (shown in FIG. 1) is formed in the third wall portion 15. The discharge port 15*a* opens in a direction tangent to a direction of rotation of the impeller 5 and discharges air to the outside. The first to third wall portions 11 to 15 are connected to form an air passage. The air passage guides the air discharged from the impeller 5 to the discharge port 15*a*.

The electric motor 3 disposed in the casing 1 includes a stator 19 and a rotary shaft 21. The stator 19 is fitted on a bearing holder 25. Two ball bearings 22 and 23 which rotatably support the rotary shaft 21 are fittedly held in the bearing holder 25. The stator 19 comprises a stator core 27, an insulator 29 made of an insulating resin, and stator windings 31. The stator core 27 is disposed outside the bearing holder 25. The insulator 29 is fitted in the stator core 27. The stator windings 31 are wound on a plurality of salient-pole portions of the stator core 27 through the insulator 29. The stator windings 31 are each electrically connected to a circuit pattern on a circuit board 35, not shown, through a connecting conductor. A drive circuit is mounted on the circuit board 35 for feeding an exciting current to the stator windings 31.

The impeller 5 which is rotated by the electric motor 3 is formed of a synthetic resin. As shown in the plan view of FIG. 3 (seen from the first wall portion 11 of the casing 1) and the back view of FIG. 4 (seen from the second wall portion 13 of the casing 1), the impeller 5 integrally includes an impeller body 37, 11 stems 39, a blade mounting member (shroud) 41, 44 main blades (33 first main blades 43 and 11 second main blades 44), and 22 sub blades 45. The impeller body 37 comprises a bottom wall 37*a* with a central portion thereof fixed to the rotary shaft 21 and a cylindrical circumferential wall 37*b*, as shown in FIG. 2. The cylindrical circumferential wall 37*b* extends along an axial line of the rotary shaft 21 and rotates about the rotary shaft 21. The impeller 5 according to this embodiment rotates in an anticlockwise direction (indicated by an arrow D1) on the page of FIG. 1 as a direction of normal rotation.

The 11 stems 39 radially extend with one end of each stem fixed to a portion of the circumferential wall 37*b* of the impeller body 37 in the vicinity of the suction port 11*a*. Then, the 11 stems 39 are arranged at intervals in a circumferential direction of the circumferential wall 37*b* or the direction of rotation of the rotary shaft 21 or the impeller 5. The term "radially extend" as used herein refers to extending inclined at a predetermined angle with respect to a completely radial direction of the circumferential wall 37*b* as well as extending in the completely radial direction. The other end of each stem 39 is terminated at a position located beyond an opening edge portion 11*b* of the suction port 11*a*.

Figure 5:
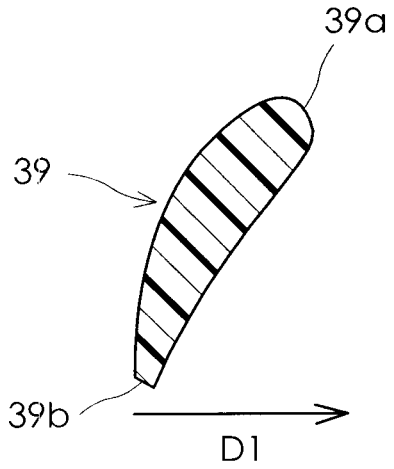
FIG. 5 is a sectional view taken along a line V-V of FIG. 1.

The stem 39 has a curved section when cut in a direction orthogonal of a longitudinal direction of the stem 39, as shown in the sectional view of FIG. 5. The curved section of the stem 39 curves to be convex in a direction reverse to the direction of normal rotation of the impeller 5 (indicated by the arrow D1). The stem 39 comprises a first end edge portion 39*a* located on the side of the suction port 11*a* and a second end edge portion 39*b* on the side of the impeller 5. The first end edge portion 39*a* is shifted more in the direction of normal rotation (indicated by the arrow D1) of the impeller 5 than the second end edge portion 39*b*. Such a shape of the stem 39 assists the impeller 5 to suck air in an axial direction of the rotary shaft 21 through the suction port 11*a*, during rotation of the impeller 5.

The blade mounting member 41 has an annular shape, and is located radially outward of the opening edge portion 11*b* of the suction port 11*a*. Then, the blade mounting member 41 is disposed radially outward of the circumferential wall 37*b*. The blade mounting member is arranged concentrically with the circumferential wall 37*b*, with the other end of each stem fixed thereto. The blade mounting member 41 includes a first side surface 41*a* facing the first wall portion 11 of the casing 1 and a second side surface 41*b* facing the first side surface 41*a* in the axial direction, as shown in FIG. 2. The first side surface 41*a* is curved to be convex toward the second wall portion 13 and is shaped so that a distance between the first side surface 41*a* and the first wall portion 11 increases radially outward. The second side surface 41*b* has a curved shape which extends in parallel with the first side surface 41*a*.

Figure 4:
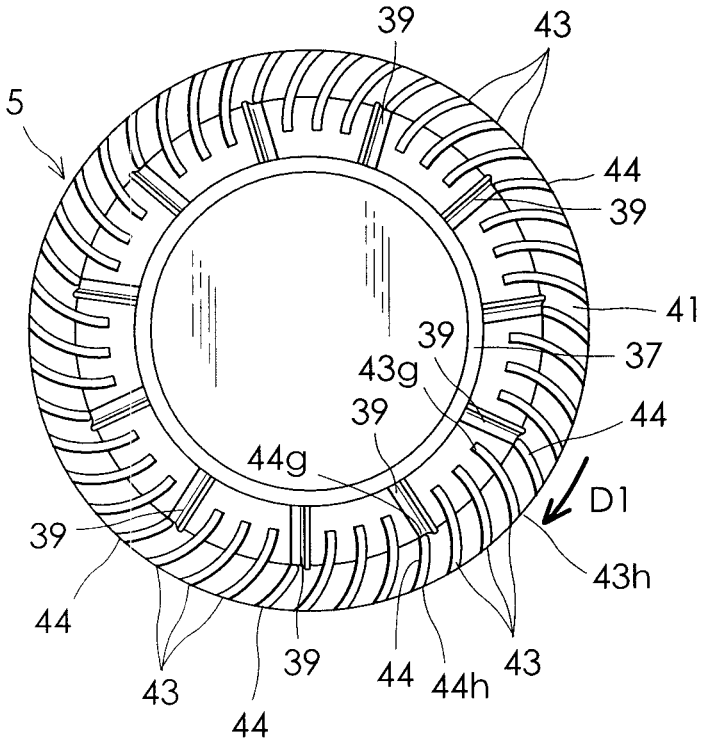
FIG. 4 is a back view of the impeller of the centrifugal fan in FIG. 1.

The 33 first main blades 43 and the 11 second main blades 44 are arranged at intervals in the direction of rotation of the rotary shaft with one end of each main blade fixed to the second side surface 41*b* of the blade mounting member 41 and extend along the axial line toward the second wall portion 13 in a direction away from the suction port 11*a*. The 33 first main blades 43 and the 11 second main blades 44 are shaped to suck air into the casing 1 in the axial direction through the suction port 11*a* when the impeller 5 rotates in the direction of normal rotation (indicated by the arrow D1). Specifically, the main blades 43 and 44 are curved to be convex in the direction opposite to the direction of normal rotation of the impeller 5 (indicated by the arrow D1), as shown in FIG. 4. Further, radially inward end portions 43*g* and 44*g* of the main blades 43 and 44 are respectively shifted from radially outward end portions 43*h* and 44*h* of the main blades 43 and 44 in the direction opposite or reverse to the direction of normal rotation of the impeller 5 (indicated by the arrow D1). Three of the 33 first main blades 43 are interposed between adjacent two of the stems 39. The first main blade 43 comprises a first side portion 43*a*, a second side portion 43*b* facing the third wall portion 15 of the casing 1, a third side portion 43*c*, and a fourth side portion 43*d* facing the second wall portion 13 of the casing 1, as shown on the right side of the paper of FIG. 2. The first side portion 43*a* extends along the second side surface 41*b* of the blade mounting member 41. The second side portion 43*b* extends in the axial direction from the one end of the main blade fixed to the blade mounting member 41. The third side portion 43*c* is located radially more inward than the second side portion 43*b*. The third side portion 43*c* includes a first half portion 43*e* and a second half portion 43*f*. The first half portion 43*e* is continuous with the first side portion 43*a*. The second half portion 43*f* is continuous with the first half portion 43*e* and the fourth side portion 43*d*. The first half portion 43*e* is inclined so that a distance between the first half portion 43*e* and the second side portion 43*b* increases toward the second half portion 43*f*. The second half portion 43*f* extends in parallel with the second side portion 43*b*.

The 11 second main blades 44 are disposed radially outward of the 11 stems 39, as shown on the left side of the paper of FIG. 2. Each second main blade 44 comprises a first side portion 44*a*, a second side portion 44*b* facing the third wall portion 15 of the casing 1, a third side portion 44*c*, and a fourth side portion 44*d* facing the second wall portion 13 of the casing 1. The first side portion 44*a* extends along the second side surface 41*b* of the blade mounting member 41. The second side portion 44*b* extends in the axial direction from the one end of the main blade fixed to the blade mounting member 41. The third side portion 44*c* is located radially more inward than the second side portion 44*b* and extends in parallel with the circumferential wall 37*b* of the impeller body 37. The main blades 43 and 44 serve to suck the air through the suction portion 11*a* in the axial direction and then direct the air in the radial direction.

Figure 3:
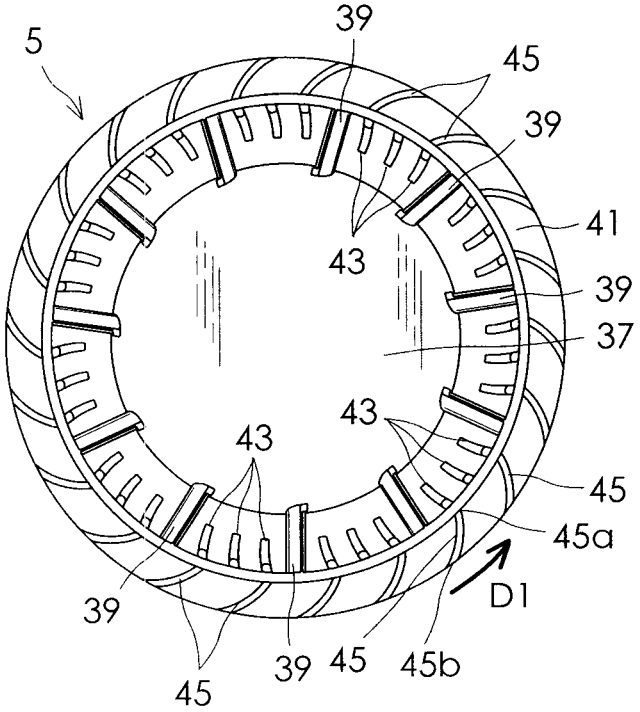
FIG. 3 is a plan view of an impeller of the centrifugal fan shown in FIG. 1.

The 22 sub blades 45 are arranged at intervals in the direction of rotation of the rotary shaft with one end of each sub blade fixed to the first side surface 41*a* of the blade mounting member 41. The sub blades extend along the axial line toward the suction port 11*a*. The number of the sub blades 45, which is 22, is set to half the number of the main blades 43 and 44, which is 44. The 22 sub blades 45 are formed to suck air into the casing 1 through the suction port 11*a* in the axial direction when the impeller 5 rotates in the direction of reverse rotation opposite to the direction of normal rotation (indicated by the arrow D1). Specifically, the sub blades 45 are curved to be convex in the direction of normal rotation of the impeller 5 (indicated by the arrow D1) (so that the sub blades 45 are convex in an opposite direction to the main blades 43 and 44), as shown in FIG. 3. Further, radially inward end portions 45*a* of the sub blades 45 are shifted from radially outward end portions 45*b* of the sub blades 45 in the direction of normal direction of the impeller 5 (indicated by the arrow D1). It means that the radially inward end portions 45*a* of the sub blades 45 are shifted in an opposite direction to the main blades 43 and 44. As known from the sub blade 45 shown on the right side of the paper of FIG. 2, defining a maximum length of each of the main blades 43 and 44 in the axial direction as L1 and defining a maximum length of each sub blade 45 in the axial direction as L2, L1 and L2 are determined so that a relationship of $\frac{1}{5}<L2/L1<\frac{1}{2}$ holds. A gap L3 formed between end surfaces 45*c* of the sub blades 45 facing the first wall portion 11 of the casing 1 and the first wall portion 11 is constant in size.

Next, the centrifugal fan in Embodiment 1, centrifugal fans in Embodiments 2 to 4, and centrifugal fans in Comparative Examples 1 to 4 shown in the following Table 1 were rotated. A relationship between an airflow rate and a static pressure of each centrifugal fan under same noise (43 dB) was then examined. The centrifugal fan in Embodiment 1 is the centrifugal fan described above. The centrifugal fan in each of Embodiments 2 to 4 has the number of sub blades different from that of the centrifugal fan in Embodiment 1, and has the same structure as the centrifugal fan in Embodiment 1 in the other respects. Sub blades of the centrifugal fan in each of Comparative Examples 1 to 4 are curved to be convex in a direction opposite to the direction of normal rotation of an impeller (so that the sub blades are convex in the same direction as main blades). The radially inward end portion of the sub blade is then shifted from the radially outward end portion of the sub blade in a direction opposite to the direction of normal rotation of the impeller (indicated by the arrow D1). It means that the radially inward end portion of the sub blade is shifted in the same direction as a main blade. The other structures of the centrifugal fans in Comparative Examples 1 to 4 are respectively the same as those of the centrifugal fans in Embodiments 1 to 4. Table 1 also shows the number of rotations and power consumptions at times of tests.

TABLE 1

| | No. Sub Blades | Rotational Speed (rpm) | Power Consumption (W) |
|---|---|---|---|
| Embodiment 1 | 12 | 6140 | 1.42 |
| Embodiment 2 | 22 | 6200 | 1.61 |
| Embodiment 3 | 33 | 6020 | 1.59 |
| Embodiment 4 | 44 | 6000 | 1.52 |
| Comparative Example 1 | 12 | 5960 | 1.53 |
| Comparative Example 2 | 22 | 5750 | 1.57 |
| Comparative Example 3 | 33 | 5810 | 1.44 |
| Comparative Example 4 | 44 | 5790 | 1.32 |

Figure 6:
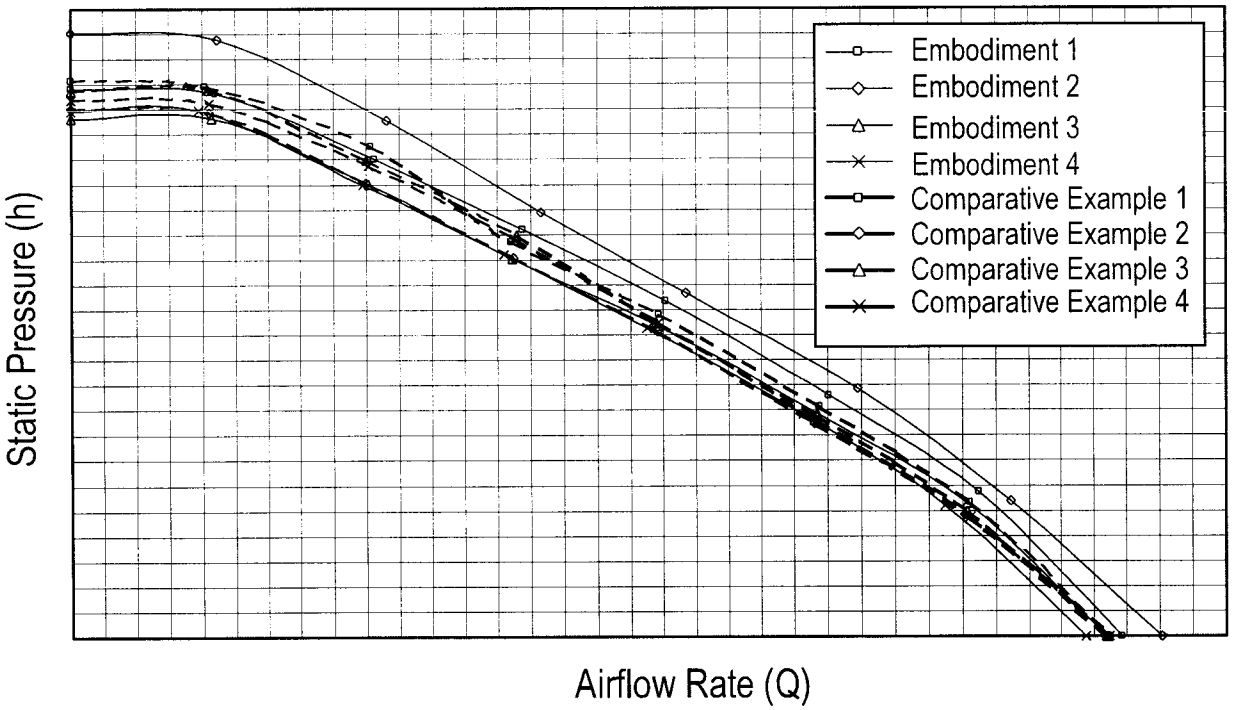
FIG. 6 is a graph showing relationships between airflow rates and static pressures under same noise in the centrifugal fan according to the first embodiment and centrifugal fans used for a test.

FIG. 6 is a graph showing measurement results. It can be seen from FIG. 6 that in each of the centrifugal fans in Embodiments 1 to 4 under the same noise (43 dB), the value of the static pressure with respect to the airflow rate may be increased more than in the centrifugal fan in each of the Comparative Examples 1 to 4 (air flow-static pressure characteristic is improved). Assume that the centrifugal fan in Embodiment 2 and the centrifugal fan in Comparative Example 2 both having 22 sub blades, the number of which is half the number of the main blades, are compared in particular. Then, it can be seen that the value of the static pressure with respect to the airflow rate in the centrifugal fan in Embodiment 2 has been increased more greatly than in the centrifugal fan in Comparative Example 2. Further, it can be seen from Table 1 that in the centrifugal fan in Embodiment 1, power consumption may be reduced more than in the centrifugal fan in Comparative Example 1 under the same noise. Preferably, power consumption is small. In the present invention, however, an increase or decrease of the power consumption does not matter in particular.

It can be seen from the results of FIG. 6 that there is not a great change in the static pressure in each of the centrifugal fans in Comparative Examples 1 to 4, even if the number of the sub blades is changed. On contrast therewith, it can be seen that in this embodiment, an arbitrary static pressure may be set within a certain wide variation range by arbitrarily setting the number of the sub blades without increasing noise.

INDUSTRIAL APPLICABILITY

According to the present invention, an arbitrary static pressure may be set within a relatively wide variation range without increasing noise by setting the number of the sub blades to an arbitrary value.

While the preferred embodiments of the invention have been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A centrifugal fan comprising:

an electric motor including a rotary shaft;

a casing including a suction port opening in an axial direction of the rotary shaft; and an impeller fixed to the rotary shaft of the electric motor to rotate therewith and including:

an impeller body which rotates about the rotary shaft;

a plurality of stems arranged at intervals in a direction of rotation of the rotary shaft with one end of each stem fixed to a portion of the impeller body in the vicinity of the suction port;

an annular blade mounting member arranged concentrically with the impeller body with the other end of each stem fixed thereto;

a plurality of blades including:

a plurality of main blades arranged at intervals in the direction of rotation of the rotary shaft with one end of each main blade fixed to the blade mounting member, the main blades extending along an axial line of the rotary shaft in a direction away from the suction port, and shaped to suck air into the casing through the suction port when the impeller rotates in a direction of normal rotation; and a plurality of sub blades arranged at intervals in the direction of rotation of the rotary shaft with one end of each sub blade fixed to the blade mounting member, the sub blades extending along the axial line toward the suction port, and shaped to suck air into the casing through the suction port when the impeller rotates in a direction of reverse rotation opposite to the direction of normal rotation;

the number of the sub blades is equal to or less than half the number of the main blades, and is equal to or more than one fourth of the number of the main blades; and defining a maximum length of each main blade in the axial direction as L1 and a maximum length of each sub blade in the axial direction as L2, L1 and L2 are determined so that a relationship of $\frac{1}{5}<L2/L1<\frac{1}{2}$ holds.

2. The centrifugal fan according to claim 1, wherein the casing is constituted from a first wall portion with the suction port formed therein, a second wall portion facing the first wall portion with the impeller interposed therebetween, and a third wall portion coupling the first wall portion and the second wall portion;

the other end of each stem is terminated beyond an opening edge portion of the suction port;

the annular blade mounting member is located radially outward of the opening edge portion and includes a first side surface facing the first wall portion and a second side surface facing the first side surface in the axial direction;

the first side surface of the annular blade mounting member is curved to be convex toward the second wall portion and is shaped so that a distance between the first side surface and the first wall portion increases radially outward; and the one end of each sub blade is fixed to the first side surface, and the one end of each main blade is fixed to the second side surface.

3. The centrifugal fan according to claim 2, wherein a gap formed between end surfaces of the sub blades facing the first wall portion and the first wall portion is constant in size.

4. The centrifugal fan according to claim 2, wherein at least one of the main blades each includes:

a first side portion extending along the second side surface of the annular blade mounting member;

a second side portion facing the third wall portion of the casing and extending in the axial direction from the one end of the main blade fixed to the blade mounting member;

a third side portion located radially more inward than the second side portion; and a fourth side portion facing the second wall portion of the casing; and the third side portion includes a first half portion continuous with the first side portion, and a second half portion continuous with the first half portion and the fourth side portion, the first half portion being inclined so that a distance between the first half portion and the second side portion increases toward the second half portion, the second half portion extending in parallel with the second side portion.

* * * * *